US005320454A

United States Patent [19]

Walling

[11] Patent Number: 5,320,454

[45] Date of Patent: Jun. 14, 1994

[54] METHOD AND APPARATUS FOR INSTALLING A FLEXIBLE PANEL INTO A TRENCH

[75] Inventor: Walter W. Walling, Conroe, Tex.

[73] Assignee: SLT Environmental, Inc., Conroe, Tex.

[21] Appl. No.: 53,682

[22] Filed: Apr. 29, 1993

[51] Int. Cl.[5] ..... E02D 5/20

[52] U.S. Cl. ..... 405/267; 405/258; 405/270

[58] Field of Search ..... 405/267, 270, 268, 258

[56] References Cited

U.S. PATENT DOCUMENTS

| | | | |
|---|---|---|---|
| 4,679,965 | 7/1987 | Glaser et al. | 405/267 X |
| 4,720,212 | 1/1988 | Steenberger et al. | 405/270 X |
| 4,828,432 | 5/1989 | Ives | 405/270 |
| 5,062,740 | 11/1991 | Payne | 405/270 |

OTHER PUBLICATIONS

SLT Curtain Wall Interlocks, Technical Publication, pp. 1-20.

*Primary Examiner*—Dennis L. Taylor
*Attorney, Agent, or Firm*—Harrison & Egbert

[57] ABSTRACT

A roller machine and method for installing a flexible panel into a trench including a frame, a prime mover connected to the frame, and a plurality of rollers positioned on the frame. The plurality of rollers defining a curved path of travel for the panel. The path of travel has an entry and an exit. The path of travel is nearly vertical adjacent to the exit above and adjacent to the trench. The prime mover is drivingly connected to at least one of the plurality of rollers. The plurality of rollers includes a plurality of support rollers extending across the frame and having an adjustable length generally corresponding to a width dimension of the panel and a plurality of guide rollers arranged in aligned pairs. The guide rollers are positioned adjacent opposite ends of the support rollers and are arranged adjacent to the exit of the path of travel. The path of travel extends between each of the aligned pairs of guide rollers. The frame is supported by a plurality of wheels so as to allow the frame to be moved adjacent to and along the length of the trench. The guide rollers are configured to accept and conform to the edge of the panel or to the interlocking connector attached to the panel. The exit position of the guide rollers is adjustable so as to enable the interlocking connector to engage a mating connector on a prior installed panel.

16 Claims, 4 Drawing Sheets

METHOD AND APPARATUS FOR INSTALLING A FLEXIBLE PANEL INTO A TRENCH

TECHNICAL FIELD

The present invention relates to methods and apparatus for installing flexible membrane liners. More particularly, the present invention relates to roller machines which are used for installation purposes.

BACKGROUND ART

Curtain walls (or cut-off walls as they are sometimes called) are extensively used as a means of separating or confining sources or potential sources of liquids or gases to prevent migration or mixing with the remainder of the environment. In their simplest form, curtain walls consist of a generally vertical barrier or restriction to lateral fluid flow. The barrier may be placed in a trench or otherwise installed across the potential route of fluid migration. The trench is most desirably of sufficient depth to reach and be sealed to a relatively impermeable strata at the lower extremity, thus providing a seal against egress of the media to be confined. This confinement is carried out so as to prevent or significantly reduce the spread of contaminants that might pollute the adjoining environment.

Various media have been used to form this barrier. This media includes materials such as clay and bentonite. More recently, synthetic membranes, such as high density polyethylene, have been used for this purpose. The membrane may be used independently or in conjunction with other barrier materials. The choice of high density polyethylene is based on its unique composition of properties of high mechanical strength, deformability, corrosion resistance, resistance to biological attack, impermeability to leachate and landfill gas, and extended service life. Other flexible membranes may also be used, if they are suitably resistant to degradation and/or permeation by the fluid t o be confined.

The high density polyethylene membranes, which are used in cut-off wall applications, are usually of a thickness of approximately 1.0 to 2.0 mm to provide sufficient mechanical strength to absorb forces encountered both in installation and in operation, to contain resulting strains within acceptable limits. Membranes of other thicknesses may be used to provide a service life consistent with the specific design purpose. Protection for the membrane such as a geotextile or selected backfill material may also be utilized in conjunction with the membrane. Where bentonite is used in the exacavation of the trench, this material also provides protection for the membrane as well as an additional sealant against fluid flow.

In certain circumstances, such as short, straight, and shallow cut-off trenches, it may be possible to easily install the membrane as a single section. However, in some cases, depth or instability of the subgrade may limit the amount of trench which can be open and maintained unobstructed at any time and in consequence require that the membrane be installed in a series of panels which must be jointed together within the trench. Other than in cases of broad open trenches where there is safe access for seaming, some form of mechanical interlock must be introduced to allow membrane panels of the appropriate width and depth to be installed consecutively with a joint which resists permeation to a degree consistent with the design objectives of the project.

The panel size may be limited by the length of an unsupported trench which can remain open for the installation. The degree of curvature of the trench and the angle of repose of backfill material must also be considered. Relatively short panels can easily be lifted vertically with a crane or hoisted and dropped or inserted into position. A framework of rigid materials may be employed to assist with the positioning of the membrane panel. The framework also serves to help resist the effects of wind as the panel is lifted. In some instances, the panel may be too long and/or wide to install with a vertical lift. In many instances, wind and/or limited head room or other obstructions may interfere with the vertical lift.

FIGS. 1A and 1B serve to illustrate the prior art technique for the installation of such flexible panels. As can be seen in FIGS. 1A and 1B, the usual approach is to suspend the panel 10, with suitable stiffening of the upper edge, above the trench 12 using a crane 14 or similar lifting equipment. The lock 16 along a vertical edge of the suspended panel 10 is entered into the lock 18 of the panel 20 already in place. The suspended panel 10 is then lowered into the trench 12. The leading edge of the in place panel 20 may be braced so as to hold it firmly in place during the fitting of the subsequent panel 10. Weights, stiffeners and/or cable arrangements may be attached to the panels so as to provide downward forces during installation. These items may also be used to assist with forming a seal or anchoring the panel in the desired position.

In FIGS. 1A, it can be seen that the suspended panel 10 is generally entered centrally into the trench 12. As can be seen, the trench 12 has a relatively narrow opening in comparison with the depth of the trench. The panels are continually installed, as shown in FIGS. 1B, until the entire length of the trench is filled with the panels.

One of the great difficulties with the installation technique, shown in FIGS. 1A and 1B, is the fact that a great deal of equipment is required for installation. When steel carrying frames are required to facilitate the installation of the panel 10, then additional expense and complication are involved. In situations where a frame must receive the panel 10, prior to installation, then the frame must be continually moved during the installation of each of the panels. Alignment must be achieved between the crane 14, any frames, and the panels 20 which are already in place. This is a highly complicated, slow, and expensive procedure. Wind can create great difficulties during this type of installation procedure. Additionally, overhead obstructions may restrict the amount of vertical lift that can be attained. In some situations, these overhead obstructions may have to be dismantled and reinstalled. Since precise alignment is required for each of the panels, a great deal of human manipulation is required so as to properly align the panels during installation. The soil conditions and characteristics adjacent to the trench may prohibit the close proximity of heavy equipment to the open trench if the trench is to remain open.

It is an object of the present invention to provide an apparatus and method for the installation of flexible panels which is relatively simple and easy to operate.

It is a further object of the present invention to provide an apparatus and method for the installation of flexible panels which requires a minimal amount of equipment.

It is still a further object of the present invention to provide an apparatus and method for installing a flexible panel which avoids wind effects.

It is another object of the present invention to provide an apparatus and method which permits installation without interferences from most overhead obstructions.

It is an additional object of the present invention to reduce the load on the soil adjacent to the open trench.

It is still a further object of the present invention to provide an apparatus and method for installing a flexible panel which greatly speeds the installation procedure and improves the overall efficiency of installation.

These and other objects and advantages of the present invention will become apparent from a reading of the attached specification and appended claims.

SUMMARY OF THE INVENTION

Initially, the present invention is a method of installing a flexible panel into the earth which comprises the steps of: (1) forming a trench or slit of a desired depth into the earth, (2) positioning a roller machine adjacent to the trench; (3) placing an edge of the panel into the roller machine; (4) rolling the panel along a path of travel within the roller machine so as to deliver the panel from a generally horizontal to a generally vertical pathway (aligned with the desired installation position) at the exit of the roller machine; and (5) releasing the panel from the exit so that the panel is received within the trench. The roller machine has a plurality of rollers therein. These rollers define the path of travel for the panel therein. The arrangement of the rollers causes the flexible panel to be suitably curved and bent during its path of travel as it is delivered into the trench.

The panel may also be delivered to the machine directly from a roll of panel material.

The step of positioning includes positioning the roller machine adjacent an edge of the trench such that the exit of the roller machine is positioned over the trench. The roller machine is supported adjacent to the trench. As the panel is positioned in the roller machine, the panel will have a portion resting generally horizontally and extending into the roller machine.

The step of rolling includes moving the panel between a plurality of rollers in the roller machine. These rollers exert a pressure on the panel so as to bend the flexible panel and joint toward the trench without permanently deforming the panel. One or more of the rollers can be driven. As these rollers are rotated, they will pull the panel through the plurality of rollers.

The method of the present invention further includes the steps of: (1) moving the roller machine along the length of the trench after releasing the panel; and (2) rolling a second panel through the roller machine so as to position the second panel adjacent to the first panel within the trench. The roller machine is moved for a distance corresponding generally to a width of the panel. The vertical edge connector of the first panel is interlocked with a connector along a vertical edge of the second panel. The roller machine positions and guides the leading edge of the panel being installed so that the panel engages t he connector of the installed panel. The second panel is rolled through the roller machine so as to cause the leading end of the connector to pass along and engage with the connector of the first panel. The second panel is released from the roller machine such that the second panel resides in interlocked connection with the first panel within the trench. The trench may then be backfilled with a selected fill material so as to contain the panel within the trench.

The present invention is also a roller machine for installing a flexible panel into a trench which comprises a frame, a prime mover connected to the frame, and a plurality of rollers positioned on the frame. These rollers define a curved path of travel for the panel. The path of panel travel has an entry and an exit. The path of panel travel is nearly vertical adjacent to the exit. A driving mechanism connected to one or more of the plurality of rollers so that the membrane and/or interlocking joint can be placed in the vertical trench from a position other than vertical without lifting the full panel into a vertical position. The roller machine can be assembled from components of much less weight than typical heavy cranes and other construction equipment for lifting. The weight of the roller machine can also be distributed over the soil adjacent to the trench in a less concentrate manner.

In the apparatus of the present invention, the plurality of rollers include support rollers and guide rollers. The support rollers extend across the frame and have a length generally corresponding to a dimension of the panel. The guide rollers are arranged in aligned pairs. These aligned pairs have a distance therebetween generally corresponding to the thickness of the panel or to the thickness of the interlocking connectors. The guide rollers are positioned adjacent to opposite ends of the support rollers. The path of travel of the panel extends between each roller of the aligned pairs.

A plurality of wheels are connected to the frame so as to support the frame adjacent to the trench. These wheels are adjustably connected to the frame. A power source such as a DC variable speed motor which is drivingly connected to at least one of the frame support wheels. The power source serves to drive the frame support wheels. The support rollers are of a variable length.

The present invention employs a mechanism, such as a guide and support, between the frame and the rollers so as to allow the exit of the rollers to be accurately positioned over the trench and/or the prior installed membrane and interlock section. This mechanism is connected to a power source, such as a hydraulic cylinder or chain drive. An arm is used so as to engage the vertical interlock on the edge of the preceding panel. This arm holds the panel so as to assure that the interlocking sections are engaged as the panel is installed.

DETAILED DESCRIPTION OF THE INVENTION

Figure 2:
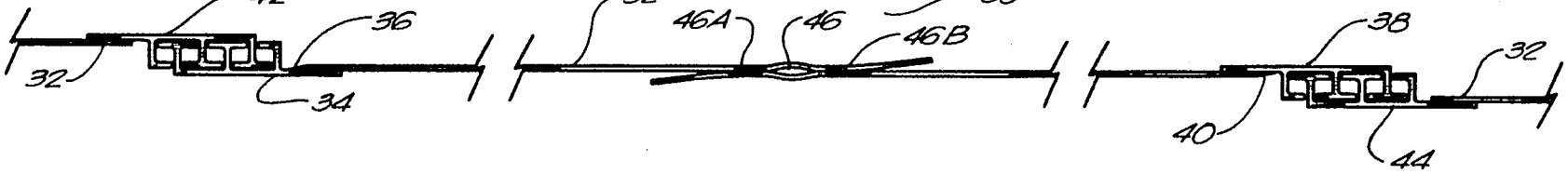
FIG. 2 is an isolated plan view of a single panel which is shown as interconnected to adjacent panels.

Referring to FIG. 2, there is shown at 30 the arrangement of flexible panels which are interconnected together in a manner similar to the installation. These panels 30 include the generally flat geomembrane 32 which has a sufficient length and width so as to accommodate the needs of the installation. The geomembrane 32 is generally made of high density polyethylene, or other suitable material. The geomembrane 32 will have a variety of thicknesses, depending upon the particular installation requirements.

As shown in FIG. 2, the geomembrane 32 has an interlock member 34 affixed to end 36 and it has an interlock 38 affixed to end 40. The interlocks 34 and 38 are connectors that can be affixed to the ends 36 and 40, respectively, by various techniques. The interlocks may be formed with a variety of geometric profiles. In this illustration, the interlocks 34 and 38 are affixed to ends 36 and 40 by fusion welds. An air test channel 46 may be incorporated into the membrane seam so as to demonstrate the integrity of the joint. The width of the panel may be increased by the seaming of the panels together at connections 46A and 46B.

As can be seen, the interlock 34 has a plurality of channels which are formed therein so as to receive the corresponding interlock 42 from an adjacent panel. It can be seen that the interlock 38 includes a plurality of slots formed therein. The interlock 44 has a plurality of T-shaped members which extend through the slots of interlock 38 and which reside within the channels of the interlock 38. In the normal techniques of installation, the T-shaped portions of interlock 42 will simply slide through the slots and channels of interlock 34. Similarly, the interlock 38 will receive the corresponding interlocking member 44 from an adjacent panel. As can be seen in FIG. 2, the interlock 34 faces in a different direction than the interlock 38. This allows for the panel 30 to be uniformly produced and assembled without being reversed for installation. The interlocks may also be installed in the same direction and the panels reversed.

Figure 1B:
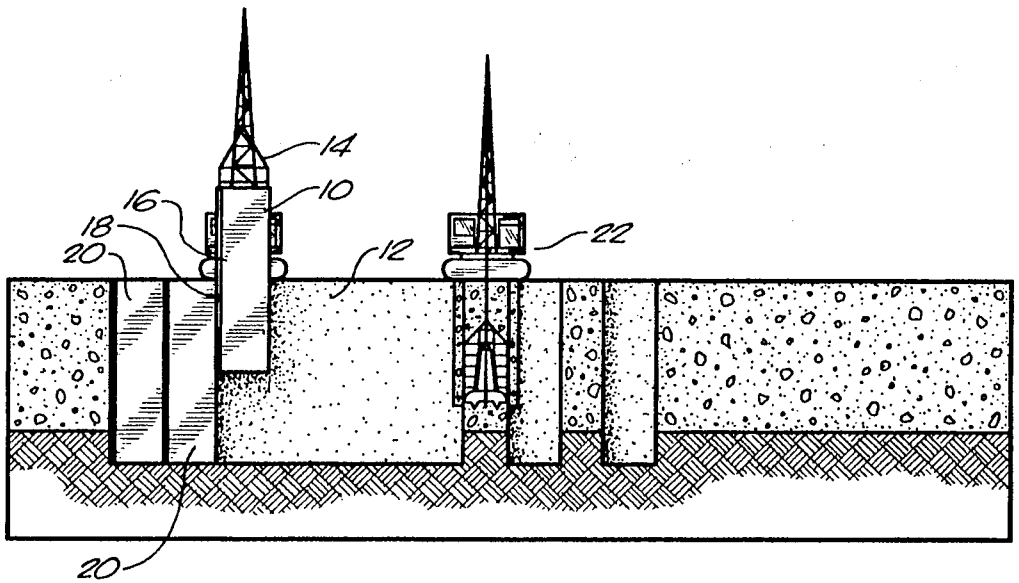
FIGS. 1A and 1B illustrate the prior art technique for the installation of flexible panels.
Figure 1A:
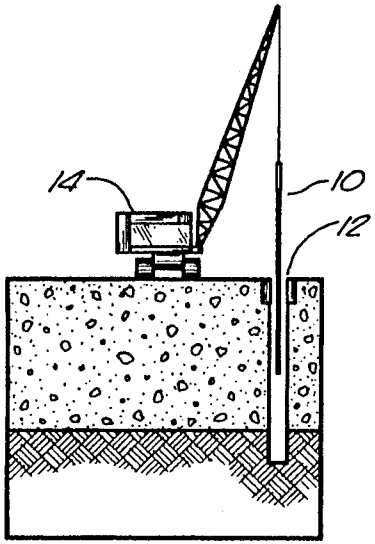

In general, the panel 30 is rather flexible. Typically, the panel 30 will have a relatively long length (greater than five meters). Additionally, the panel 30 will not have an excessive thickness. As a result, the high density polyethylene, or membrane material, which is used for the manufacture of the panel 30 will provide the panel 30 with flexibility. Although the flexibility of the panel 30 can be detrimental to the installation techniques in FIGS. 1A and 1B, such flexibility particularly suits the purposes of the method and apparatus of the present invention, to be described hereinafter.

Figure 3:
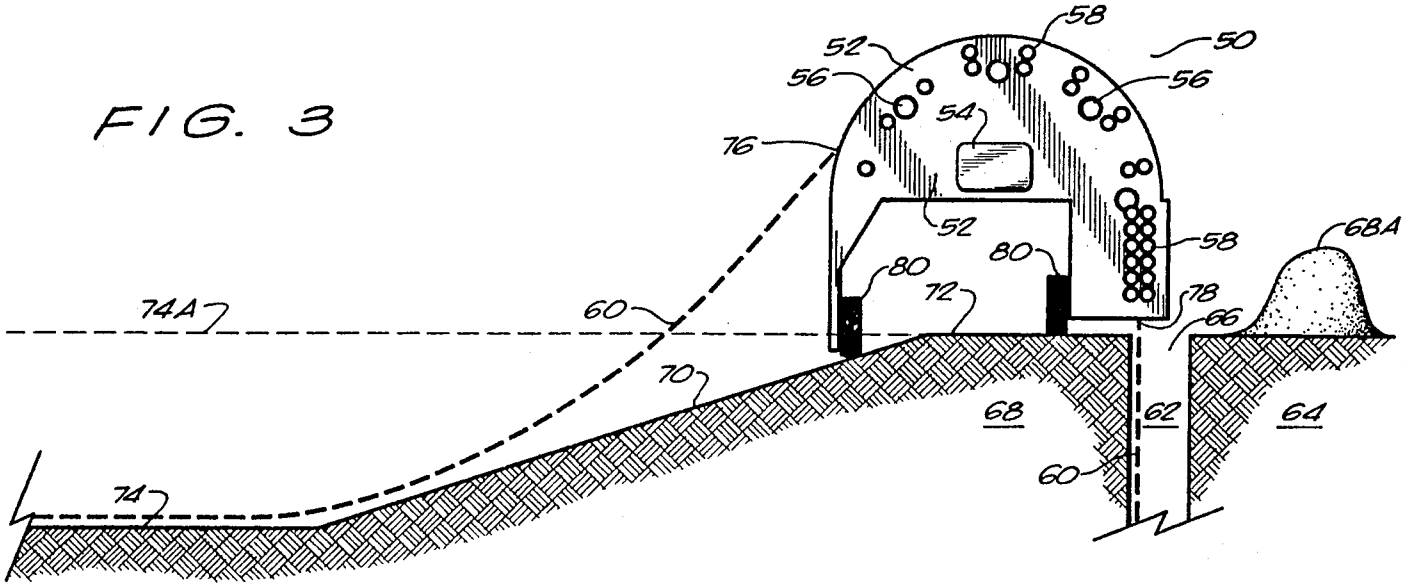
FIG. 3 is a side elevational view showing the method and apparatus of the present invention.

The method and apparatus of the present invention is illustrated at 50 in FIG. 3. Specifically, the roller machine 50 includes a frame 52, a prime mover 54, a plurality of support rollers 56, and a plurality of guide rollers 58. In FIG. 3, it can be seen that the panel 60 is illustrated in dotted line fashion. The roller machine 50 is positioned so that the panel 60 can be properly installed, in a vertical fashion, within trench 62. In addition, the roller machine 50 can align and position the interlocking joints so that the adjacent panels are properly connected.

Initially, the trench 62 is formed to a desired depth in the earth 64. The trench 62 can be formed by digging the trench through conventional digging techniques, or a variety of other methods. Normally, the trench 62 will have a relatively narrow opening 66 in comparison with its depth. The purpose of the present invention is to install the flexible panel 60 so as to create a barrier between the earth 64 on one side of the panel 60 and the earth 68 on the other side of the panel 60.

As the trench 62 is dug into the earth, the material 68A which is removed from the trench is placed to the side of the trench. Alternatively, this material 68A may be used to build a ramp 70 and a support surface 72. As can be seen, the support surface 72 has a relatively flat configuration adjacent to an edge of the trench 62. The ramp 70 extends upwardly from the bottom 74 to the support surface 72. This ramp is gently inclined. Ramp 70 has a length to height ratio of 2½ to 1, as illustrated. However, this should not be construed as a limitation on the present invention. Various other sizes, shapes, and configurations of support surface 72 and ramp 70 can be found within the scope of the present invention. The description of the ramp 70 and the support surface 72 is for the purpose of describing the present invention and not the only means for accomplishing the purpose of the present invention. Additionally, although it is described herein that the ramp 70 and the support surface 72 are made from the material which is excavated from the trench 62, it is possible that other material could be utilized for the purposes of the present invention. The installation technique of the present invention can also be carried out with no ramp or especially constructed support surface.

In FIG. 3, a dotted line 74A illustrates the configuration of the support surface where no slope is employed. When the roller machine 50 is used on surface 74A, the panel 60 will be positioned in a generally horizontal arrangement. The roller machine 50 will serve to change the orientation of panel 60 from the horizontal position on surface 74A to a vertical orientation for entry into trench 62.

The continuing integrity of the trench ca be enhanced, or the passage of the material to be confined temporarily restricted, by filling the trench with a liquid or slurry, such as a bentonite mixture, without restricting the use of this invention for installation of the membrane.

In FIG. 3, it can be seen that the roller machine 50 is positioned adjacent an edge of the trench 62. The roller machine 50 includes an entry 76 and an exit 78. The exit 78 is positioned so a to extend over the trench 62. Between the entry 76 and the exit 78, the combination of support rollers 56 and guide rollers 58 form a path of travel for the panel 60.

Initially, as the panel 60 is installed into the entry 76 of the roller machine 50, a portion of the panel 60 will reside on the surfaces 70 and 74. The surface 74 can be used so as to provide additional support for the panel 60 as it is being pulled through the roller machine 50 of the present invention. Additional supplies of the panels 60 can be continually placed on the surface 74 or on the ramp 70 so as to facilitate their ready installation into the roller machine 50, as needed. As such, the roller machine facilitates the efficiency of installation of the panels 60 into the trench 62.

In FIG. 3, it can be seen that the roller machine 50 has a plurality of wheels 80. The wheels 80 may be of adjustable height so as to allow for the machine 50 to be adaptable to a wide variety of surfaces. It can be seen that the wheels 80 are arranged in generally parallel relationship to the trench 62. By the configuration of the wheels 80, in combination with the frame 52 of roller machine 50, the machine 50 can be moved along the support surface 72 a needed for the installation of the panel 60 into trench 62. After the panel 60 is installed into the trench 62, the roller machine 50 can be moved for a distance along the length of the trench corresponding to the width of the panel 60. A second panel can then be positioned into the roller machine 50 so that the roller machine can position a second panel adjacent to and interlocked with the first panel within trench 62. As the panels are installed in trench 62, the interlocking connector of panel 60 (as illustrated in FIG. 2) is engaged with an interlocking connector of an adjacent panel. To install this interlocking connector, a leading edge of the second panel is guided so that the connector of the second panel can engage the connector of the first panel. The second panel can be rolled through the roller machine 50 so as to cause the leading edge of the panel to pass downwardly and along the interlocking connector of the first panel. Eventually, the second panel is released from the roller machine 50 so that the second panel resides in an interlocked connection with the first panel within the trench. The method of the present invention shall continue in this fashion until all of the panels are installed in the trench 62.

After the installation of the panels is completed, then the earth 68A (or other selected material) can be used so as to fill in the trench and to contain the pane 60 within the trench. Other techniques could also be employed to suitably fill the trench 62.

Figure 4:
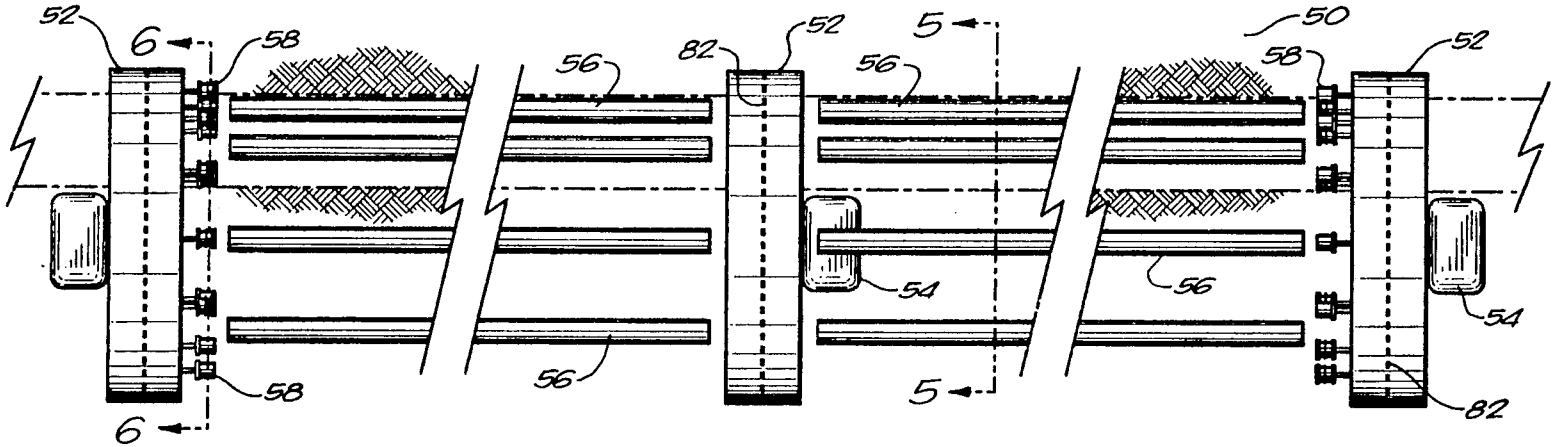
FIG. 4 is a plan view of the roller machine in accordance with the preferred embodiment of the present invention.

FIG. 4 illustrates a plan view of the roller machine 50 of the present invention. Essentially, roller machine 50 shows how the support rollers 56 are arranged within the frame 52. FIG. 4 also illustrates how the guide rollers 58 are configured with respect to the frame 52. The support rollers 56 generally extend across the frame. These support rollers 56 have a length which generally corresponds to the width of the panel passing thereover. The support rollers support the underside of the panel as it passes along a curved path of travel within the frame 52 of the roller machine 50. The support rollers 56 can have a variable length to accommodate the various widths of geomembranes and panels which pass thereover. The frame 52 simply provides a support and housing for the plurality of rollers 56 and 58, the prime movers 54 and the wheels 80.

The guide rollers 58 are positioned generally adjacent to opposite ends of the support rollers 56. As can be seen, the guide rollers 58 are positioned adjacent to the frame 52. In normal use, the guide rollers 58 will engage the edges of the panel 60 as it is entering and exiting the roller machine 50. At least some of the guide rollers 58 are drivingly connected to prime mover 54. The guide rollers 58 serve to exert a force on the edges of the panel 60 so as to both "grasp" the panel 60 and to "pull" the panel 60 through the machine 50. The roller machine 50 will create a curved path of travel for the panel along the top surfaces of the support rollers 56 and within the guide rollers 58. This curved path of travel will be sufficient to bend the panel 60 for the purposes of installation within trench 62 without permanently distorting the panel 60. The prime movers 54 are typically electric or hydraulic variable speed motors which rotate the guide rollers 58 by a drive mechanism 82. Similarly, prime mover 54 can be interactive with chain drive 82 for rotating the support rollers 56. Another prime mover could be connected to the guide rollers 58, and the other end of the roller machine 50, for the purpose of providing coordinated movement of the panel 60 through the roller machine 50.

Figure 5:
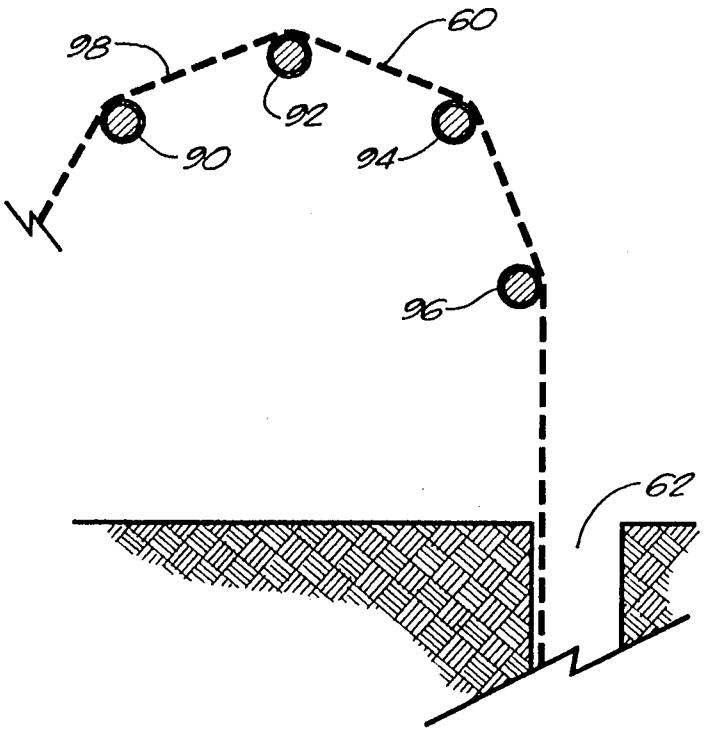
FIG. 5 is an illustration of the roller machine of the present invention as taken across lines 5—5 of FIG. 4.

FIG. 5 shows how the panel 60 is supported on the top surface of the support rollers 90, 92, 94, and 96. The panel 60 is pulled through the roller machine in a manner such that the underside 98 of panel 60 travels in surface-to-surface contact with the outer surfaces of each of the support rollers 90, 92, 94, and 96. As such, the panel 60 will not distort across its width between the guide rollers. The arc formed by the arrangement of support rollers 90, 92, 94, and 96 is relatively shallow so as to avoid any permanent distortion of the material of the panel 60. Support roller 90 provides a suitable "entry" roller for the panel 60. Additionally, support roller 96 serves to direct the panel 60 toward the opening of trench 62. Both the action of the guide rollers and of gravity generally assure that the panel 60 will contact the surfaces of the support rollers.

Figure 6:
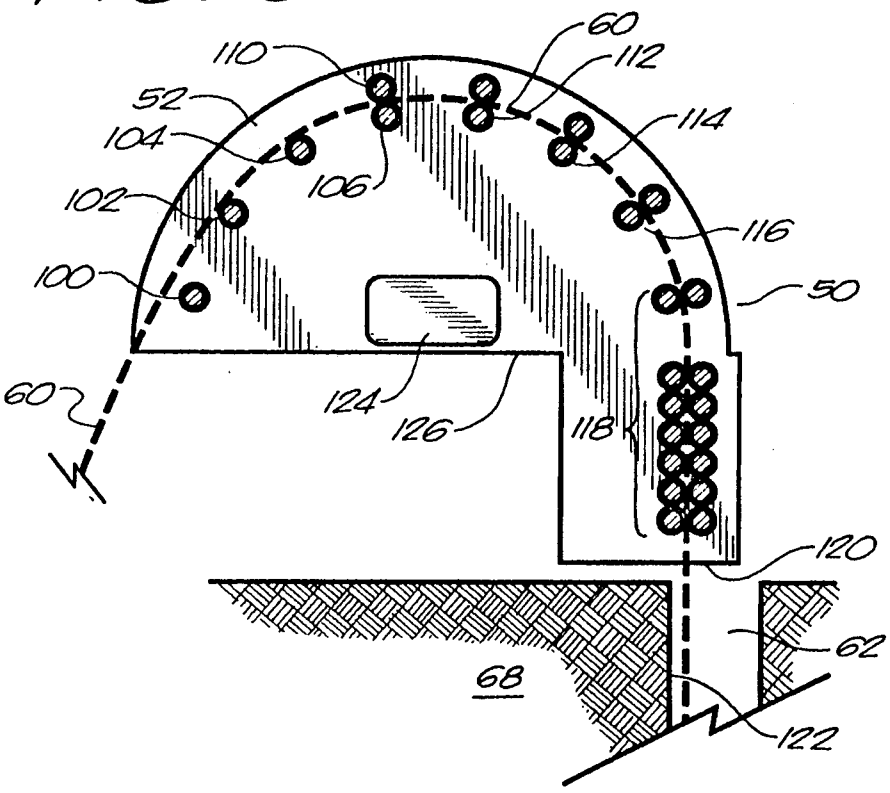
FIG. 6 is a cross-sectional view of the roller machine of the present invention as taken across lines 6—6 of FIG.

FIG. 6 illustrates how the guide rollers 58 are used for the purposes of directing the panel 60 (shown in broken line fashion) into the trench 62. Initially the guide rollers 5B include entry rollers 100, 102, and 104. As the panel 60 enters the roller machine 50, the entry rollers 100, 102 and 104 serve to receive the leading edge of the panel 60. As the panel 60 moves upwardly within roller machine 50, the guide rollers 106 and 110 serve to grasp the leading edge of the panel 60. It can be seen that the guide rollers 106 and 110 are a spaced apart pair of rollers. The distance between each of the rollers 106 and 110 generally corresponds to the thickness of the panel 60 or to the geometry of the interlock along the edges of the panel. In particular, the rollers 106 and 110 can have a distance and configuration therebetween which allows the interlocking connectors to pass therethrough. So as to cause the panel 60 to move through the curved path of travel through the roller machine 50, the rollers 106 and 110 must exert a suitable force on the outer and inner surfaces of panel 60. These rollers 106 and 110 will direct the panel 60 through the aligned pairs of rollers 112, 114, and 116. After passing through these rollers, the panel 60 will enter into a group of closely arranged rollers pairs 118. The group of rollers 118 define the exit 120 of the roller machine 50. The group of rollers 118 causes the panel 60 to assume a nearly vertical path of travel into and toward the trench 62. The close spacing of the rollers 118 assures that the panel 60 assumes a flat, vertical configuration upon exit. Essentially, the group of rollers 118 serves to "flatten out" any curvature that could develop in the panel 60 by passing over the previously-mentioned groups of rollers. It can be seen that the exit 120 extends outwardly beyond the support for the roller machine 50 above the earth 68. This allows the exit 120 to be properly aligned with the panel 60 positioned within the trench 62. As the panel 60 is installed into trench 62, a surface of the panel 60 may, when desired, be caused to reside adjacent to the side 122 of trench 62. This further facilitates the alignment of the panels 60 when they are arranged together in interlocking fashion.

As can be seen in FIG. 6, the drive motor 124 is positioned on a support housing 126 of frame 52.

Figure 7:
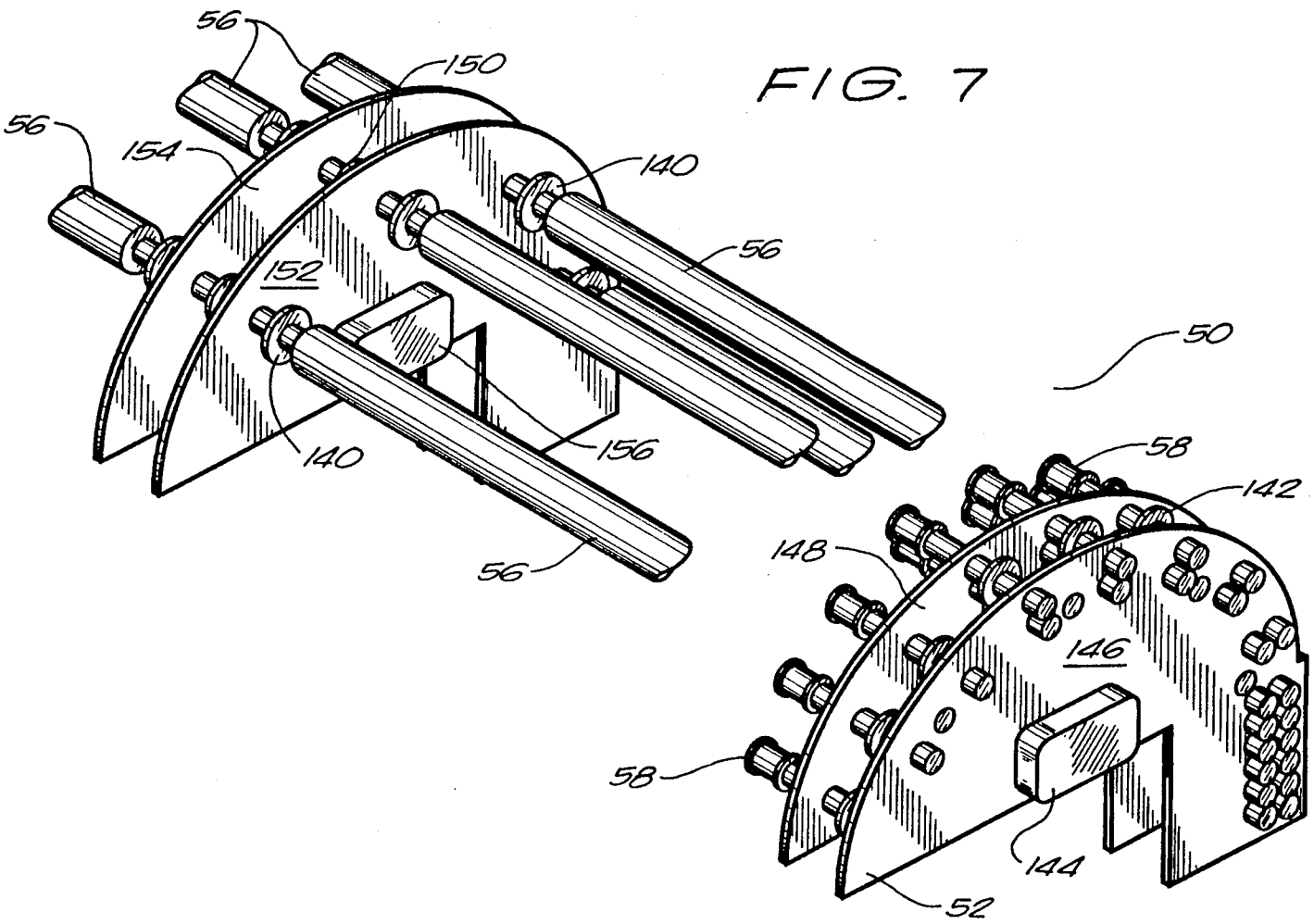
FIG. 7 is a partial isometric view of the roller machine of the present invention.

Referring to FIG. 7, there is shown a partial isometric view of the roller machine 50 of the present invention. Specifically, it can be seen that the frame 52 supports the configuration of rollers. The membrane support rollers 56 are shown as extending along drive axles 140.

Additionally, it can be seen that the group of rollers 58 extend toward the support rollers 56 on an inner side of the frame 52. Each of the guide rollers 58 is connected on a suitable drive mechanism 142 so that the motor 144 can cause the rotation of the guide rollers 58 at a desired speed. The frame 52 includes a first frame portion 146 and a second frame portion 148. Suitable bearings, and other mechanisms, can be installed within the frame portions 146 and 148 so as to facilitate the rotation of the guide rollers 58 and the support rollers 56. The support rollers 56, and their axles 140, are connected to a drive 150 between walls 152 and 154. Similarly, the axles 140 extend so as to support the support rollers 56 on the other side of wall 154. The drive 150 is powered by the drive motor 156. As can be seen, each of the components is interactive so as to allow for the proper "pulling" of the panel 60 through the roller machine 50 for the purpose of installing the panel 60 into the trench 62.

The present invention offers significant advantages over prior art techniques for the installation of such geomembrane panels. First, the present invention offers an installation technique that avoids the requirement of cranes and frames. By keeping the panel adjacent to ground level, the wind effects on the panel are generally avoided. The use of the roller machine of the present invention allows for a large number of panels to be sequentially placed along the travelling surface of the roller machine. As such, as one panel is installed, the machine can be moved so as to allow for the receipt of a second panel. There is no complex reassembly of frames, hoists, and connectors, as required by the prior art systems. The alignment of the panel adjacent to a wall of the trench further facilitates the ability to align an interlock connector of one panel with an interlock connector of another panel. The guide rollers of the roller machine further serve to provide a precise guidance to these connectors for the purposes of rapid installation. Since the roller machine of the present invention is relatively easy to operate, no complex training, with respect to crane operation or installation procedures, is required. The present invention serves to maximize the efficiency of such panel installation. In addition the present invention provides a flexible membrane installation machine that may be designed to reduce the load on the soil adjacent to the open trench.

The foregoing disclosure and description of the invention is illustrative and explanatory thereof. Various changes in the details of the illustrated construction, or of the steps of the described method, may be made within the scope of the appended claims without departing from the true spirit of the invention. The present invention should only be limited by the following claims and their legal equivalents.

I claim:

1. A method of installing a flexible panel into the earth comprising:

forming a trench of a desired depth into the earth;

positioning a roller machine adjacent said trench, said roller machine having a plurality of rollers therein, said rollers defining a path of travel for the panel therein;

placing an edge of the panel into the roller machine;

moving the panel between a plurality of rollers in said roller machine, said rollers exerting a pressure on the panel so as to bend the panel toward the trench, said rollers defining a generally vertical pathway at an exit of said roller machine; and releasing the panel from the exit so that the panel is received within the trench.

2. The method of claim 1, said step of forming comprising:

digging said trench to be of a size for the receipt of a plurality of flexible panels, said trench having a relatively narrow opening in relation to a depth of said trench.

3. The method of claim 1, said step of positioning comprising:

positioning said roller machine adjacent an edge of said trench such that the exit of said roller machine is positioned over the trench.

4. The method of claim 1, said step of rolling further comprising:

activating a motor on said roller machine, said motor drivingly connected to at least one of said plurality of rollers: and driving said roller so as to pull said panel through said plurality of rollers.

5. The method of claim 1, said panel having a connector along a vertical edge, said method further comprising the steps of;

moving said roller machine along a length of said trench after releasing the panel, said roller machine moved for a distance corresponding generally to a width of said panel; and rolling a second panel through said roller machine so as to position the second panel adjacent the first panel within the trench.

6. The method of claim 5 further comprising the step of:

interlocking the connector of the first panel with a connector along a vertical edge of the second panel.

7. The method of claim 6, said step of interlocking comprising:

guiding a leading edge of the second panel so that the connector of the second panel engages the connector of the first panel;

rolling the second panel through the roller machine so as to cause said leading edge to pass along the connector of the first panel; and releasing said second panel from said roller machine such that said second panel resides in interlocked connection with said first panel within said trench.

8. A roller machine for installing a flexible panel into a trench comprising:

a frame;

a prime mover means connected to said frame; and a plurality of rollers positioned on said frame, said plurality of rollers defining a curved path of travel for the panel, said path of travel having an entry and an exit, said path of travel being nearly vertical adjacent said exit, said prime mover means drivingly connected to at least one of said plurality of rollers, said plurality of rollers comprising:

a plurality of support rollers extending across said frame, said support rollers having a length generally corresponding to a dimension of the panel; and a plurality of guide rollers arranged in aligned pairs, said aligned pairs generally separated by a distance corresponding to a thickness of the panel.

9. A roller machine for installing a flexible panel into a trench comprising:

a frame;

a prime mover means connected to said frame; and a plurality of rollers positioned on said frame, said plurality of rollers defining a curved path of travel for the panel, said path of travel having an entry and an exit, said path of travel being nearly vertical adjacent said exit, said prime mover means drivingly connected to at least one of said plurality of rollers, said plurality of rollers comprising:

a plurality of support rollers extending across said frame, said support rollers having a length generally corresponding to a dimension of the panel; and a plurality of guide roller means arranged and aligned in pairs, said guide roller means configured to receive and guide an interlocking connector of the panel so as to position the interlocking connector for engagement with another interlocking connector of another panel.

10. The roller machine of claim 8, said guide rollers positioned adjacent opposite ends of said support rollers, said guide rollers arranged adjacent said exit of said path of travel, said path of travel extending between each of said aligned pairs.

11. The roller machine of claim 9, said guide roller means positioned adjacent opposite ends of said support rollers, said guide roller means arranged adjacent said exit of said path of travel, said path of travel extending between each of the aligned pairs.

12. The roller machine of claim 8, further comprising:

a plurality of wheels connected to said frame, said plurality of wheels for supporting said frame adjacent the trench.

13. The roller machine of claim 12, said wheels being adjustably connected to said frame so as to allow a relative height of said wheels to be varied.

14. The roller machine of claim 8, said prime mover means being a variable speed motor drivingly connected to at least one of said guide rollers, said motor having a sufficient power so as to cause the panel to be pulled through said plurality of guide rollers.

15. The roller machine of claim 8, said support rollers attached to a drive axle extending across said frame, said drive axle having a drive mechanism connected thereto, said prime mover means for driving said drive mechanism, said support rollers rotating in relation to the movement of said drive axle, said support rollers being of a variable length.

16. The roller machine of claim 8, said frame having means for supporting said frame above a surface, said exit of said path of travel extending outwardly beyond said means for supporting, said exit adaptable so as to be positioned over and adjacent to an edge of said trench.

* * * * *